US006105652A

United States Patent [19]

Judkins

[11] Patent Number: 6,105,652

[45] Date of Patent: Aug. 22, 2000

[54] VENETIAN TYPE BLIND HAVING SEPARATELY TILTING SLAT SECTIONS

[76] Inventor: Ren Judkins, 46 Newgate Rd., Pittsburgh, Pa. 15202

[21] Appl. No.: 09/198,023

[22] Filed: Nov. 23, 1998

[51] Int. Cl.[7] ..... E06B 3/32

[52] U.S. Cl. ..... 160/115; 160/167 R; 160/176.1 R; 160/178.3 R

[58] Field of Search ..... 160/115, 167 R, 160/168.1 R, 176.1 R, 173 R, 177 R, 178.1 R, 178.3 R

[56] References Cited

U.S. PATENT DOCUMENTS

| | | | |
|---|---|---|---|
| 7,108 | 6/1850 | Bohrer . | |
| 12,695 | 4/1855 | Rose . | |
| 330,936 | 11/1885 | Sorlie . | |
| D. 372,828 | 8/1996 | Sticker . | |
| 2,116,356 | 5/1938 | Laborda et al. | 160/115 |
| 2,214,539 | 9/1940 | Reinike | 160/115 |
| 2,283,640 | 5/1942 | Kwon . | |
| 2,409,943 | 10/1946 | Kwon | 160/167 R |
| 2,427,266 | 9/1947 | Ewing | 160/115 |
| 2,587,696 | 3/1952 | Collier | 160/115 |
| 2,719,586 | 10/1955 | Graham . | |
| 2,730,171 | 1/1956 | Clark | 160/167 R |
| 2,757,726 | 8/1956 | Rice et al. . | |
| 2,836,237 | 5/1958 | Hogin et al. . | |
| 3,111,164 | 11/1963 | Lombard . | |
| 4,940,070 | 7/1990 | Warden . | |
| 5,205,335 | 4/1993 | Horton et al. . | |
| 5,443,108 | 8/1995 | LeVert et al. . | |
| 5,573,051 | 11/1996 | Judkins . | |
| 5,692,552 | 12/1997 | Judkins | 160/176.1 R |
| 5,806,579 | 9/1998 | Judkins | 160/168.1 R |
| 5,839,494 | 11/1998 | Judkins . | |
| 5,918,657 | 7/1999 | Tuzmen | 160/168.1 R |

FOREIGN PATENT DOCUMENTS

| | | | |
|---|---|---|---|
| 268623 | 2/1969 | Austria | 160/115 |
| 485353 | 7/1952 | Canada . | |

*Primary Examiner*—Blair M. Johnson
*Attorney, Agent, or Firm*—Buchanan Ingersoll, P.C.

[57] ABSTRACT

A venetian type blind has a bottomrail, a headrail positioned above the bottomrail and a set of slats. Upper slats or no slats are carried on a set of upper ladders extending from the headrail and a set of lower ladders extending from the bottomrail. Each upper ladder is connected to a lower ladder by a connection device that connects an upper ladder rail to a lower ladder rail. Alternatively, all of the ladders can be connected to a single rail located between the headrail and the bottomrail. The upper ladders are connected to a tilt mechanism. At least two lift cords are attached to the bottomrail, running past slats through the headrail. At least two tilt cords are provided. Each tilt cord runs through the headrail, passing adjacent to one rail of an upper ladder and is connected to either one connector or a rail of the ladder adjacent to a connector.

34 Claims, 12 Drawing Sheets

VENETIAN TYPE BLIND HAVING SEPARATELY TILTING SLAT SECTIONS

FIELD OF INVENTION

This invention relates to venetian type blinds which can have slats that can be tilted from an open horizontal position to a closed tilted position.

BACKGROUND OF THE INVENTION

Venetian blinds consist of a plurality of horizontal slats. These slats rest on ladders made of cord, fabric tape, or flexible sheets of sheer material. Blinds have a headrail and bottomrail, the bottomrail being either one solid rail or two parallel rails connected by a cord. The blinds have a lift cord or cords, traditionally connected from the bottomrail through route holes in the slats, to a lift mechanism or cord lock in the headrail. Another arrangement is provided in my U.S. Pat. No. 5,573,051, in which lift cords are placed proximate to the front and rear edges of the slats, and tiny notches or slots are made in the slats for the lift cords to pass through from the bottomrail into the headrail.

Blinds are raised to stack slats at the top by pulling the lift cords through a cord lock, which locks into place by pulling the lift cords laterally to catch the lock and then back to set the lock. Alternately, an axle driven cord collection system may be used for one or more sets of lift cords in place of a cord lock. All the slats in a venetian are typically all tilted the same amount, whether it is open at horizontal, closed at vertical, or somewhere in between. The blind cannot have one portion that is open and another portion which is closed unless the owner turns the slats individually. Yet, there has been a demand for blinds in which the upper half of the blind can be open to allow light to come in and for occupants to see out, while the lower half of the blind is closed to prevent glare or fading and afford privacy to the occupants. The upper half can be open by having the slats tilted at horizontal or by having no slats at all in the upper half of the blind. This invention describes ways of accomplishing this without resorting to the more complicated controls inherent in a bottom and top stacking blind.

In U.S. Pat. No. 7408, Bohrer describes a so-called bottom-up venetian blind in which all slats can be stacked at the bottomrail by means of a pulley assembly. He introduced a movingrail which houses a tilt mechanism and to which the ladders are connected to hold the slats. The operator lifts the movingrail by pulling a lift cord through a pulley assembly, then hooking the cord onto cleats. This design tilts the slats by pulling a tilt cord connected to a tilt mechanism in the movingrail which twists the movingrail and is difficult to operate. The lift cords must be pulled and cleated at an angle to the wall, creating a less streamlined, less neat appearance.

A similar blind is described by Rose in U.S. Pat. No. 12,695. Rose uses a fixed headrail and a movingrail and provides a complex series of hooks and cords to lock the movingrail into place at the headrail. This facilitates the tilting of the slats relative to the movingrail by holding it steady. The mechanism, however, is complicated and uses several pieces of additional hardware not necessary in traditional venetian type blinds. It also requires the blind to be lifted to the headrail to be tilted.

In U.S. Pat. No. 2,283,640, Kwon describes a blind which also uses a movingrail, but with a different lifting and tilting mechanism. The blind is raised from a bottom-stacked position by pulling and cleating two sets of tilt/lift cords simultaneously; the blind is tilted by pulling one set of the cords more than the other. This arrangement requires two-hand operation of the blind, which is difficult in many room settings. It also involves shifting the center of gravity of the blind away from or toward the window, causing a gap between the tilted blind and the window in the first case and causing the stack to drag on the wall or the window in the second case.

Most recently, Levert et al. describe an upwardly deployed blind in U.S. Pat. No. 5,443,108. This design consists of a fixed headrail, a movingrail, and a bottom rail. The tilt assembly is again placed on the movingrail. The blind is raised from a bottom-stacked position by pulling a drawstring in the headrail connected to a cord lock. To tilt the blind, a tilt bar on the movingrail is used. This reduces the twist of the movingrail somewhat, but is very bulky and is potentially awkward to operate because the movingrail is constantly changing position relative to the operator.

These previous inventions allow the operator more choices as to how to stack the blind for the desired combination of light passage and privacy. Yet, they require more controls for the operator to understand and none of these blinds allow some of the slats to be in an open horizontal position while other slats are in a closed tilted position. There is a need for a venetian blind which provides an inexpensive and relatively simple way to leave the top half of the window open. Ideally, this blind will also require a minimum of additional hardware for a fabricator to make blinds with different cording and hole configurations such as slats with route holes in the centerline, slats with hidden holes in the rear of the slats, or slats with no holes. Also the blind should be able to utilize cord ladders, fabric tape ladders, or sheer material sheet ladders.

SUMMARY OF THE INVENTION

This new invention takes the blind described in my U.S. Pat. No. 5,692,552 and adds a set of ladders connected to the headrail tilting mechanism. It uses the movingrails, couplers, or points of connection between the upper set of ladders and the lower set of ladders. Although this added feature allows for a large variety of options it is expected that consumers will most appreciate the simple alternative of having what appears to be a regular blind that can be operated like a regular blind with the additional feature of being able to tilt the lower set of slats independently of the upper set. When it is not desired to have slats covering the top portion of the window the consumer will appreciate the single set of controls that this improved blind affords.

My venetian type blind has a bottomrail, a headrail positioned above the bottomrail and a set of slats. A set of lower slats are carried on a set of lower ladders extending from the bottomrail toward the headrail and a set of upper slats may also be carried by a set of upper ladders extending from the headrail toward the bottomrail. Each upper ladder is preferably connected to a lower ladder by being connected with a coupler that connects an upper ladder rail to a lower ladder rail, or the front rails of both sets can be connected to the front bar of a two piece or double movingrail and the back sets can be connected to a back bar. Alternatively, all of the ladders can be connected to a single rail located between the headrail and the bottomrail. The upper ladders are connected to a tilt mechanism in the headrail. At least two lift cords attached to the bottomrail, run past the slats and into the headrail. In embodiments that have slats in the upper set of ladders, at least two tilt cords are provided. Each tilt cord runs in the headrail, then descends passing adjacent to one rail of an upper ladder and is connected to the lower set of ladders by being tied, crimped, sewn, or otherwise connected directly to the one of the ladder rails or by attachment to a coupler or movingrail that is in turn connected to a lower ladder rail.

The hardware of this blind will accommodate cord, fabric tape, or sheet ladders. There will always be at least one pair of lift cords which lift the bottomrail and all the slats. The lift cords may pass through route holes in the center or on the back edges of the slats to the bottomrail. Alternately, the lift cords could pass through notched slats to the bottomrail in an edge lift system.

A preferred tilt mechanism in the fixed headrail uses disks or bars to which the upper set of ladders are connected. The bottomrail lift cords are also connected to these disks except where a centerline route hole system is used. Finally, the tilt cords, when used, also pass through these disks. To tilt all the slats in the blind, the disks or bars are rotated, the ladders, lift cords, and tilt cords are moved up and down simultaneously together when the disks raise either the cords and ladders going to the front or rear side of the blind while lowering the other side.

There are several distinct advantages of my new venetian type blind which set it apart from those attempted earlier. The tilt mechanism shifts the weight of the blind while maintaining the center of gravity rather than lifting the weight, which would cause a shift in the center of gravity. The distance of the blind from the window is therefore the same when tilted in either direction. The tilt and lift controls for the bottomrail may be operated independently of one another and can both be operated with simple one-hand controls. The lift cords can be lifted on an axle driven cord collection system if desired. The tilt cords can terminate at a tilter box or pass through a cord lock, both of which would rotate in tandem with the disks. Thus, when the disks are tilted all the cords are tilted the same amount. When the tilt cords are activated, they act only on the lower set of ladders and slats and the reaction force of the disks is supplied by the tilt rod tilter while the cord tilter supports the tensile forces. Furthermore, by containing all the lifting and tilting hardware in one fixed headrail, the same hardware can be used "as is" in the traditional and new types of blinds, such as the centerline lift cord system, the hidden holes lift system, the edge lift system, a fabric tape ladder design, and a fabric sheet ladder design. A manufacturer or fabricator will not need to produce or purchase a new and expensive hardware system to make any of these types of blinds or any combination of these blind elements.

DETAILED DESCRIPTION OF THE PREFERRED EMBODIMENTS

Figure 1:
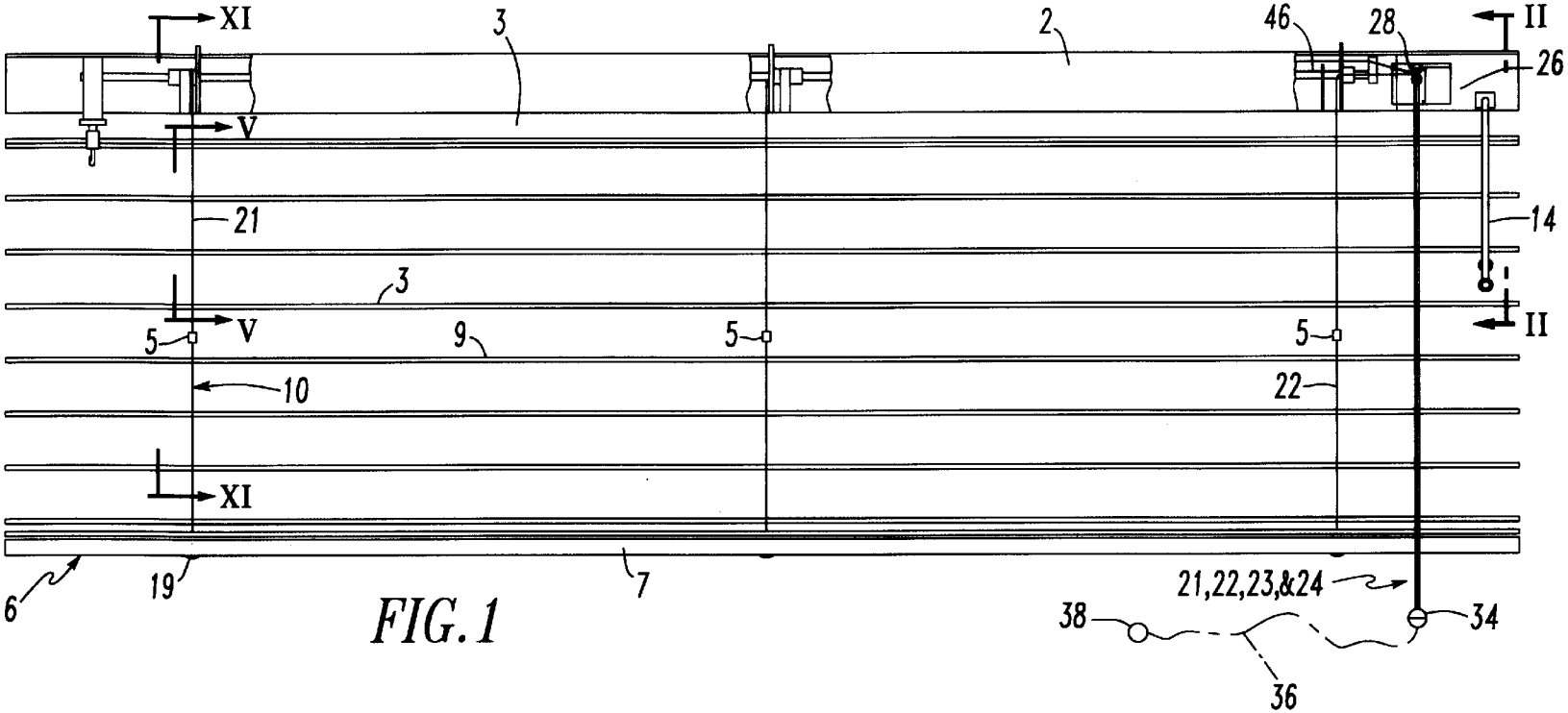
FIG. 1 is a front view of the present preferred embodiment of my venetian type blind shown in an unstacked position.

The first preferred embodiment, as best shown in FIGS. 1–4 11, 12 and 13, has a fixed headrail 2 housing a tilt mechanism for the upper ladders and an incremental tilt mechanism for the lower ladders. A single bottomrail 6 or a double bottomrail having a front rail 7 and a rear rail 8. A set of upper ladders 4 extend from the headrail to couplers 5 which connect the upper ladders 4 to lower ladders 10. The upper ladders may have loops 20 on the back, the front, or both. The lower ladders extend from the couplers 5 to the bottomrail. The upper and lower ladders may be one continuous piece length of ladder and the coupler may simply connect the tilt cord to the ladder thereby creating the upper and lower junction. If desired a single hinged connector such as a bar 5*a* shown in chainline in FIG. 11 could be used in place of the couplers on each ladder. One could attach a set of lift cords to bar 5*a* allowing the bar to function as a movingrail or a tilting rail. In this case, the upper ladders would optionally not need to be attached to the lower ladders. These lift cords could be routed adjacent the bottomrail lift cords and interwoven with the ladder rungs or run in separate loops 20 that are knitted into the ladder rails. Preferably the loops would only be on the back side since they are not very attractive. Then the loops and the tilt cords are hidden from view. This also reduces the number of cords needed to tilt the blind.

Figure 3:
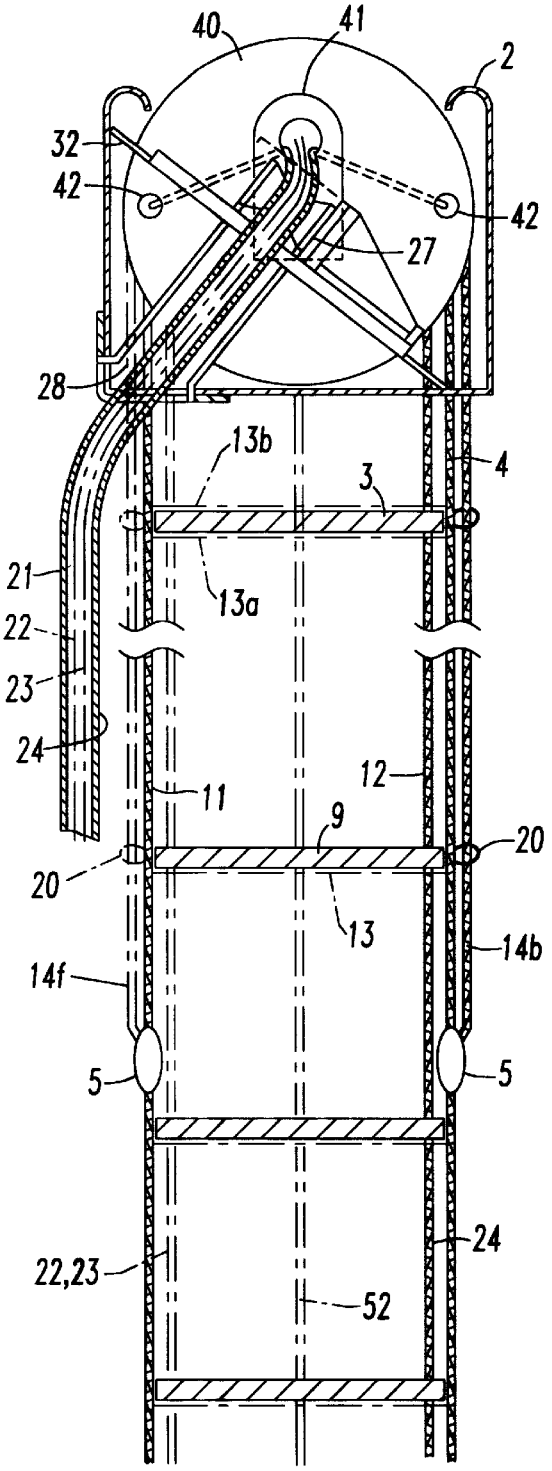
FIG. 3 is a sectional view taken along the line III—III of FIG. 1.
Figure 4:
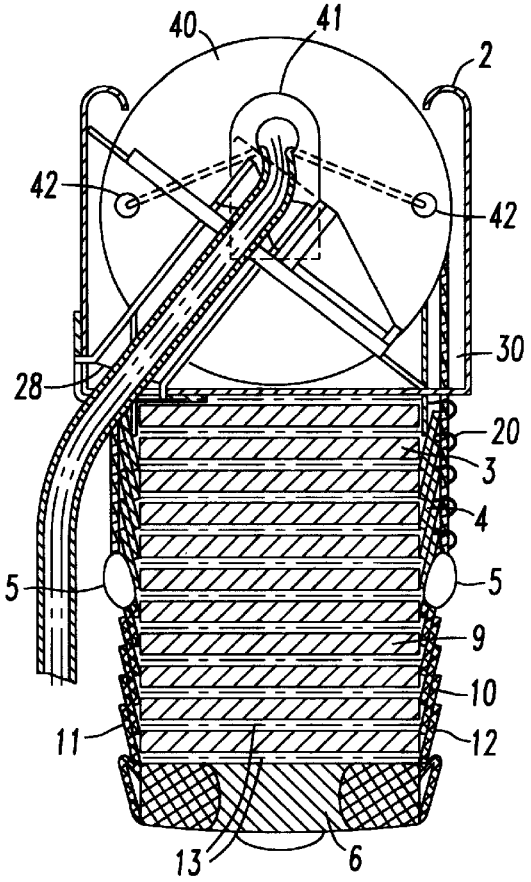
FIG. 4 is a sectional view similar to FIG. 3 taken along the line IV—IV of FIG. 2.
Figure 5:
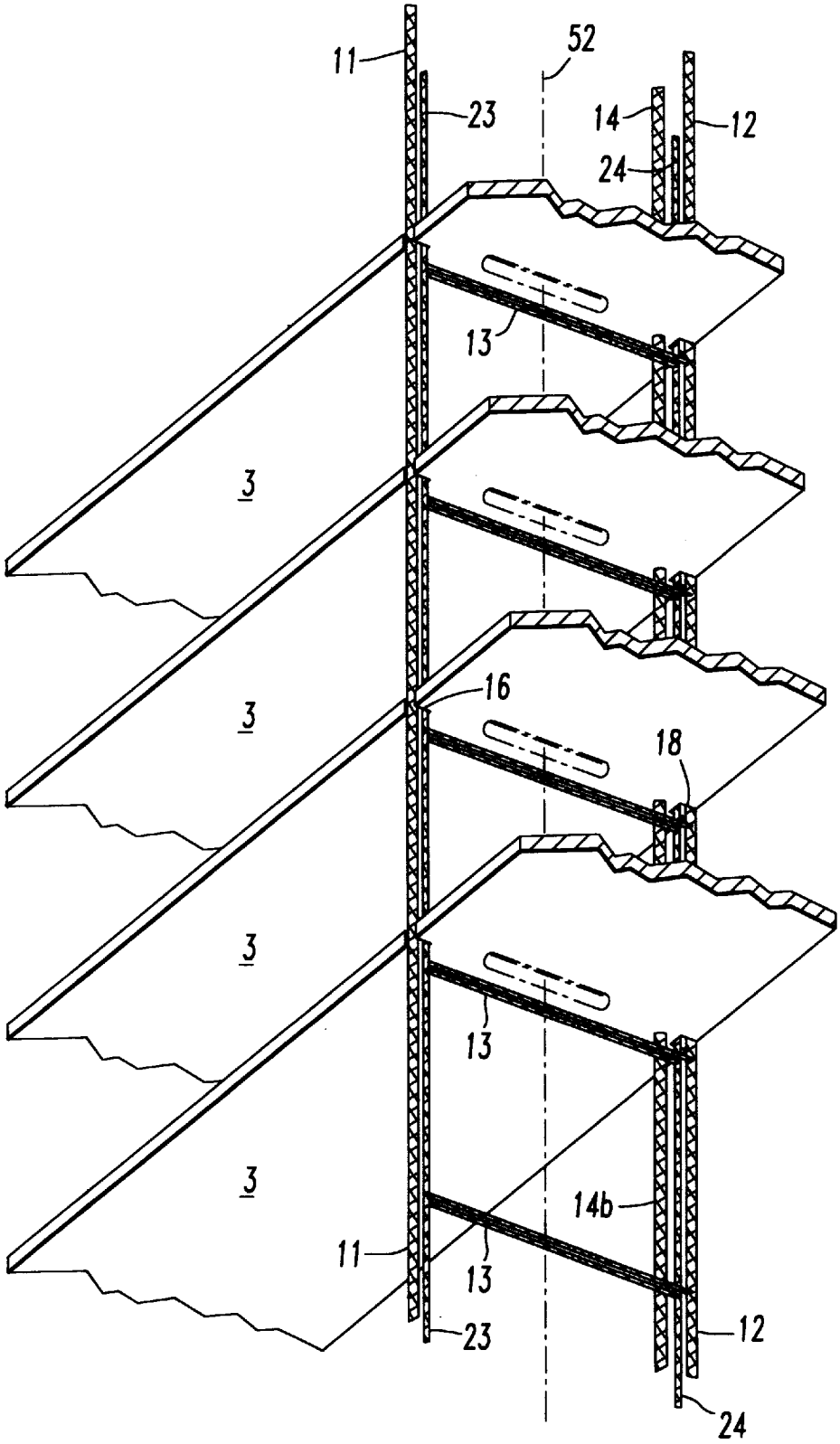
FIG. 5 is a perspective view of a portion of the embodiment shown in FIG. 1 taken around the line V—V of FIG. 1 but showing the tilt cord inside the ladder rail.

A set of lower slats 9 are positioned between the bottomrail and the couplers 5 and rest on lower ladders 10. Upper slats 3 are carried on the upper ladders 4. Although each upper ladder is illustrated as being aligned with or co-linear with a lower ladder this is not necessary. There could be more lower ladders than upper ladders, as occurs in the embodiment shown in FIG. 20, or more upper ladders than lower ladders. The upper ladders could be offset from the lower ladders. In those instances the upper ladders would be connected to the lower ladders through a movingrail or other connecting structure. The ladders 4and 10 consist of front rails 11, rear rails 12, and rungs 13 on which the slats rest. Bottomrail lift cords using any of the common cording routes can be used. The number of lift cords may vary from two for a single bottomrail to four or more for a double bottomrail or wide blinds. Centerline cords require at least two descending cords that support the bottomrail 6. When a two piece bottomrail is used then a centerline cord cannot be used and either a hidden hole cord or an edge lift system should be used. In either case, each bar requires two points of support. This is shown in FIG. 3 where lift cord 24 passes up near the back ladder rail through slots in the slat edges or offset holes that are very close to the edge of the slat. Lift cord 21 is also on the backside, but it is on the opposite or left side of the blind and thus is hidden in this view. It is shown descending from the lock. If a hidden hole cording is used, then front lift cords 22 and 23 are not necessary unless a two piece bottomrail is used or it is desired to preventing the stack from tipping over and swinging back. If an edge lift system is used, then at least one cord is needed in the front depending on whether a two piece rail is used. The tilt cord 14*b* on the back side is preferred because it is hidden from view. Using cords on only one side reduces the number of tilt cords required and thereby simplifies fabrication. However, a tilt cord 14*f* could be run through loops 20 on the front or woven in the ladder behind the front ladder rail 11.

When the disks are rotated, all of the cords except a centerline cord are rotated in tandem and tilt all of the slats an equal amount. When the tilt cords are lifted or lowered, only the lower slats are tilted an incremental amount. The weight of the lower blind is shifted from either the front rails to the back rails or vice versa. This is why the tilt mechanisms for both the disks and the tilt cords should be a worm gear or similar system that can support a load. At least two tilt cords 14 are provided. Each tilt cord extends from a coupler 5 along one rail of one of the ladders, preferably a rear rail 12 of an upper ladder 4 through a cord lock 28 in the headrail.

Figure 2:
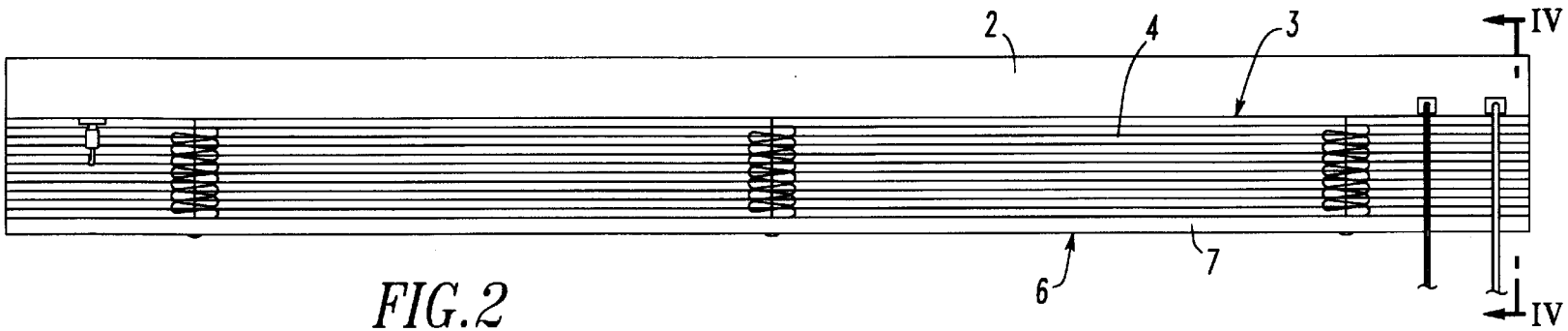
FIG. 2 is a front view similar to FIG. 1 showing the blind when it is in a raised and top-stacked position.

For illustration purposes, varying numbers of slats are shown in the figures. Any number of slats, most likely more than are shown, will be used. The slats shown are symmetric to a horizontal plane passing through the front and back edges of the slat. Other types of slats, such as crowned, s-shaped, or asymmetrical slats, may be used instead of the flat slats. The slats are suspended on a cord type ladders 4, 10. A third upper ladder and a third lower ladder that are not accompanied by lift cords is shown in FIGS. 1 and 2. More ladders and lift cords may be used for wider or heavier blinds. Ladder rungs are preferably groups of two to four cords. If desired, the slats could be woven between the cords. I have found that the uppermost slat tends to flip over during operation of the blind. Threading the slat 3 between the rung cords 13*a* and 13*b* as shown in FIG. 3 prevents the slat from flipping over. The lowermost slat of the upper group also tends to flip unless it has a movingrail or a bar to oppose the forces that tend to bring the ladder rails together. As shown in FIGS. 1 and 2, the bottom ends of the ladders are knotted within the bottomrails 7, 8, and are covered by plugs 19. If desired, cord ladders could be replaced with fabric tape ladders or sheets of flexible material.

Figure 6:
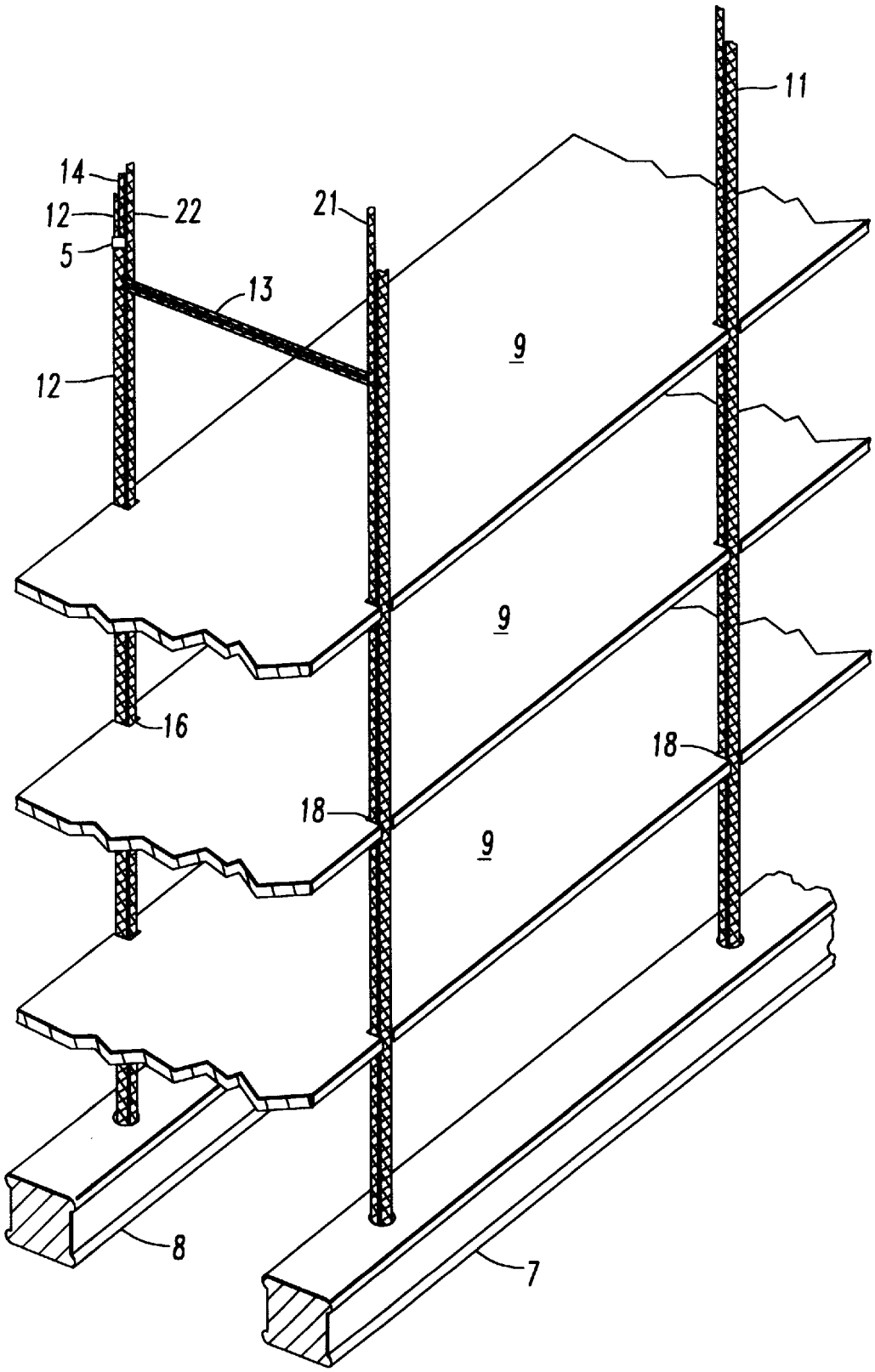
FIG. 6 is a perspective view of an alternate bottomrail lift cord arrangement using a two-piece bottomrail.
Figure 7:
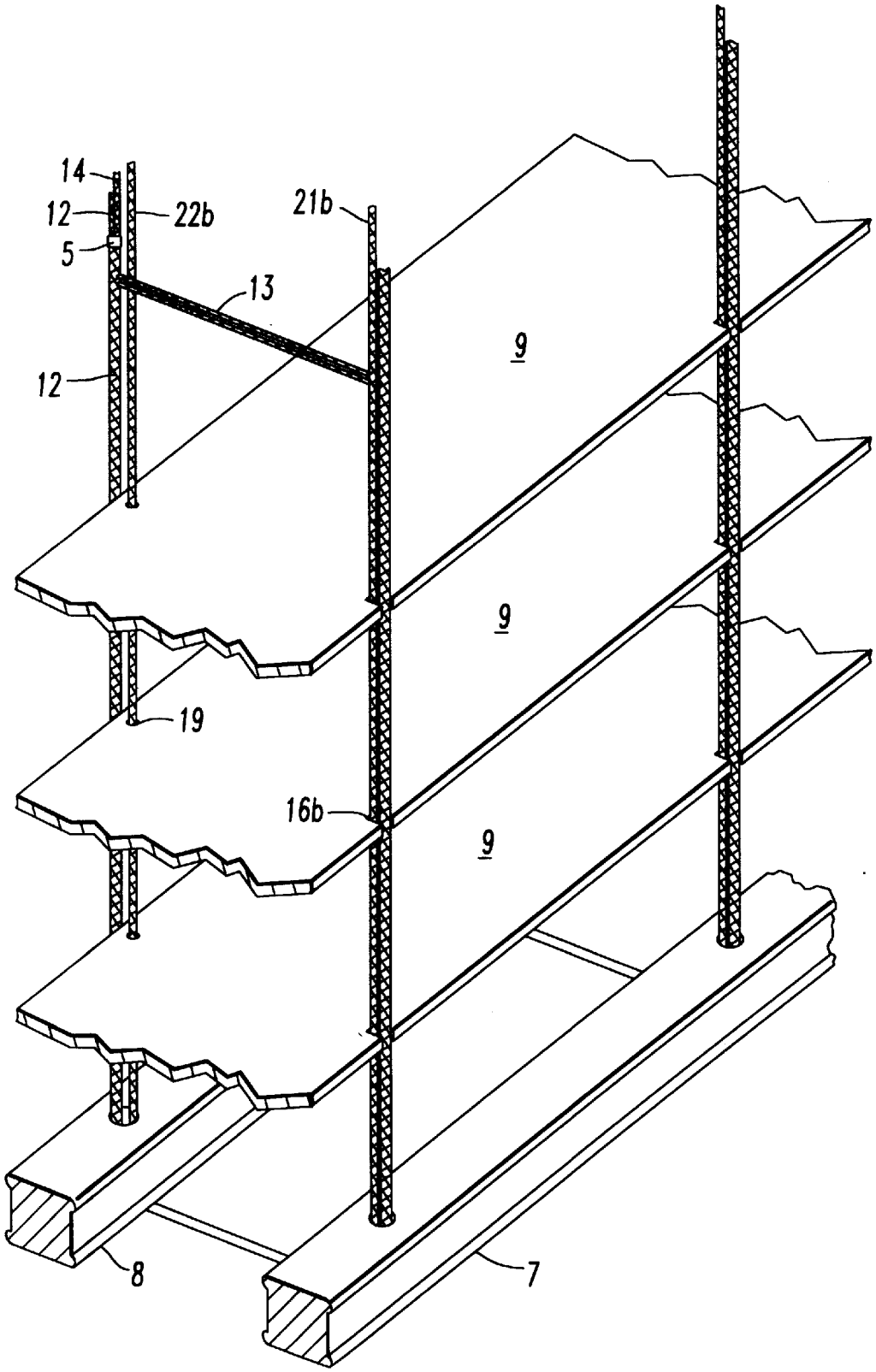
FIG. 7 is a perspective view similar to FIG. 6 showing the hidden holes lift cord option for the lift cords of the bottomrail.

One set of four lift cords 21–24 passes from the bottomrail 3 through the headrail and into a cord lock 26. These lift cords support and control the bottomrail thereby transferring the tilting motion of the tilt mechanism. Only one cord is needed on each side of a single bottomrail. However, I prefer the two-piece bottomrail as shown in FIG. 6. Lift cords 21 and 23 extend from the front bottomrail 7 into the headrail. Cords 22 and 24 extend from rear bottomrail 8 through the headrail. Each pair of lift cords 21, 22 and 23, 24 is threaded through the headrail 2 where they are supported by the tilt mechanism.

The tilt cords 14 run through a second cord lock 26. This cord lock is designed to be in a locked position until the user pulls tilt cord 14 to raise one side of the lower ladders. Each tilt cord 14 could be connected to a ladder rail. Pulling the tilt cord 14 raises the rear of the ladder rails causing the lower slats to tilt as shown in FIGS. 11 through 19. Optionally, one can provide a second tilt cord 15 along the front rails 12 of the ladders 4, 10 as shown in dotted line in FIG. 11. Tilting in one direction is accomplished by pulling tilt cord 14 while tilting in an opposite direction is done by pulling tilt cord 15. Another option is to construct the couplers so that lowering a tilt cord increases the length of the adjacent ladder rail thereby allowing the weight of the lower slats to be supported completely by the opposite ladder rail. The slats hang from that ladder rail in a nearly vertical or closed position.

These tilt cords can be used in a no-holes blind such as is shown in FIG. 3 where lift cords 21,22,23,24 pass through edge slots or where lift cords 21 and 24 pass through edge holes, or where a centerline cord 52 is used.

FIGS. 1–4 and 9–19 show the preferred tilt mechanism. The tilt assembly is supported by cradles 50. The lift cords 21–24 pass through the disk 40 at the disk cord guides 42, then pass through the tilt rod centering cord guide 41. The cords from the left side 23, 24 pass through the center disk, the right disk, the right tilt rod cord guide, and finally extend over a pulley 27 and into a cord lock 28 provided in the headrail. Preferably, the cord lock is always engaging the lift cords unless the blind is being raised or lowered. A support plate 30 is provided to attach the cord lock 28 to the headrail 2. Support 32 holds pulley 27 in place. The lift cords 21–24 pass through this lifting and tilting assembly to a position outside the headrail 2 at one end of the blind, in this case the right side. The distal end of the lift cords may be tied together in a ball connector 34. If desired a pull cord 36 having a tassel 38 may be connected to the ball connector 34.

Figure 11:
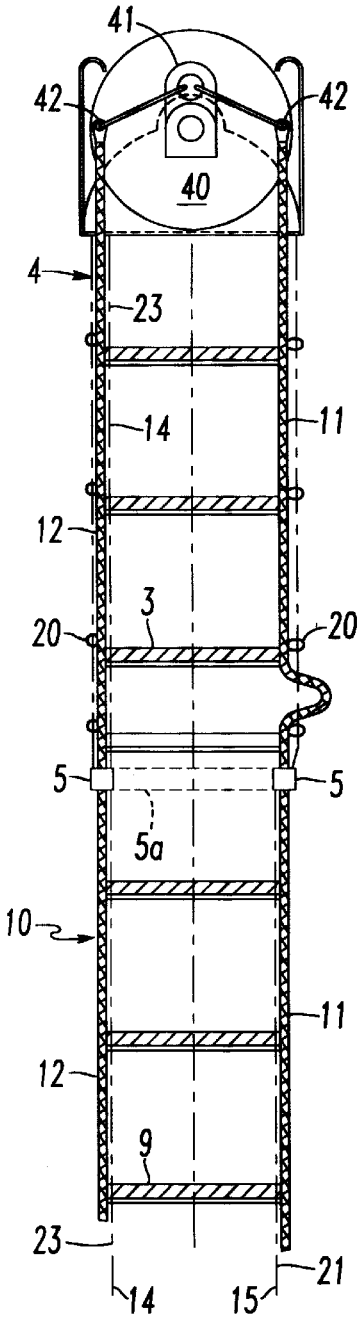
FIG. 11 is a sectional view taken along the line XI—XI of FIG. 1 with the lift cords shown in chain line and the tilt cords shown in dotted line for clarity.
Figure 12:
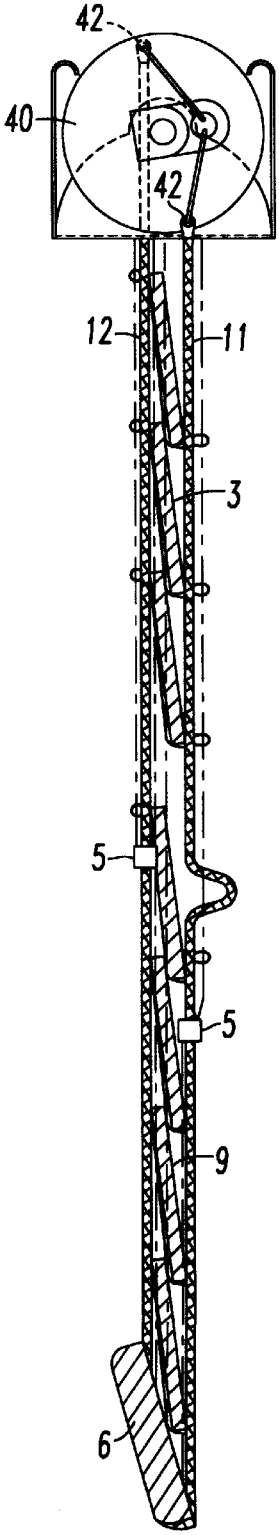
FIG. 12 is a sectional view similar to FIG. 11 showing the blind in a closed, tilted position.
Figure 13:
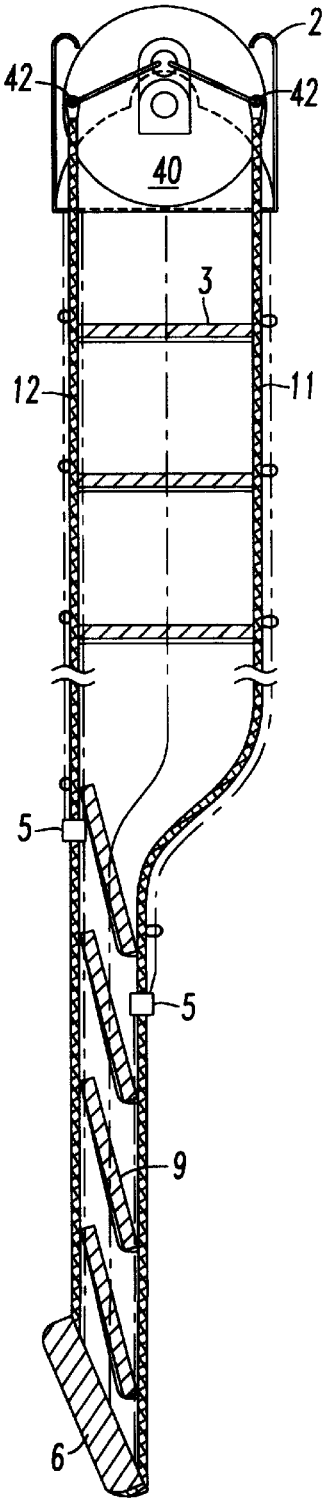
FIG. 13 is a sectional view similar to FIG. 11 showing the upper slats in an open, horizontal position and the lower slats in a closed, tilted position.
Figure 14:
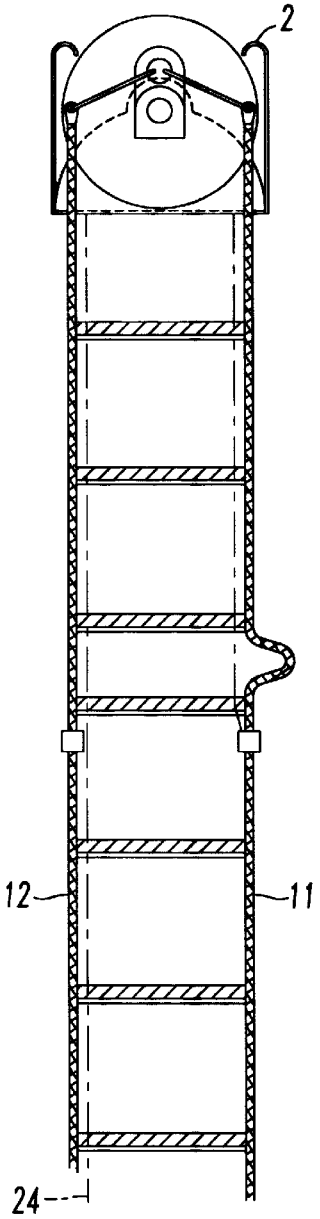
FIG. 14 is a sectional view similar to FIG. 11 of a second embodiment of my blind which utilizes hidden holes for the lift cords.
Figure 15:
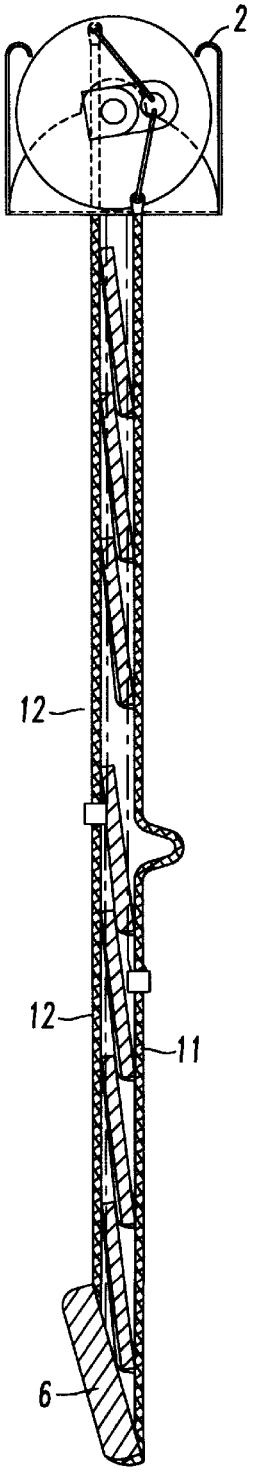
FIG. 15 is a sectional view similar to FIG. 14 showing the blind in a closed, tilted position.
Figure 16:
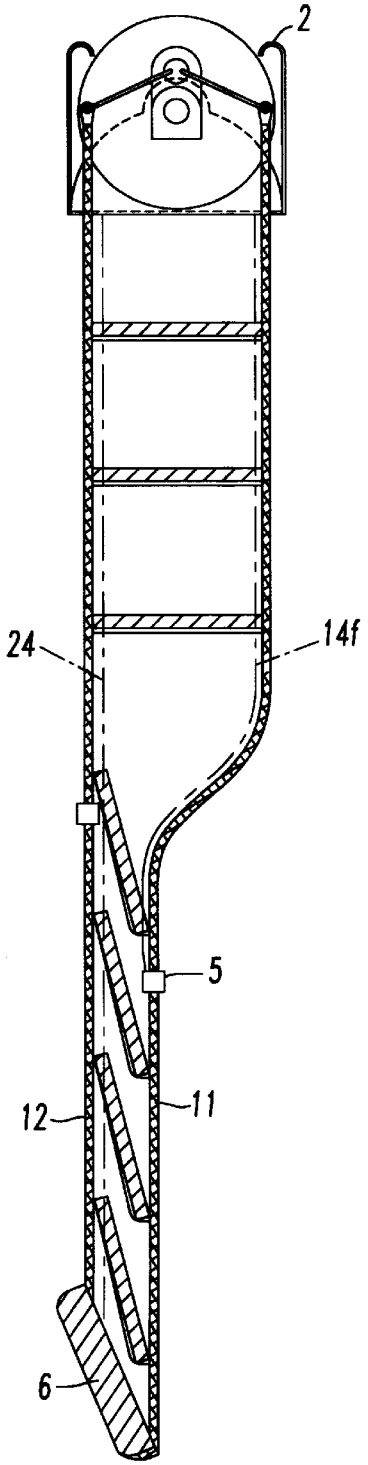
FIG. 16 is a sectional view similar to FIG. 14 showing the upper slats in an open, horizontal position and the lower slats in a closed, tilted position
Figure 17:
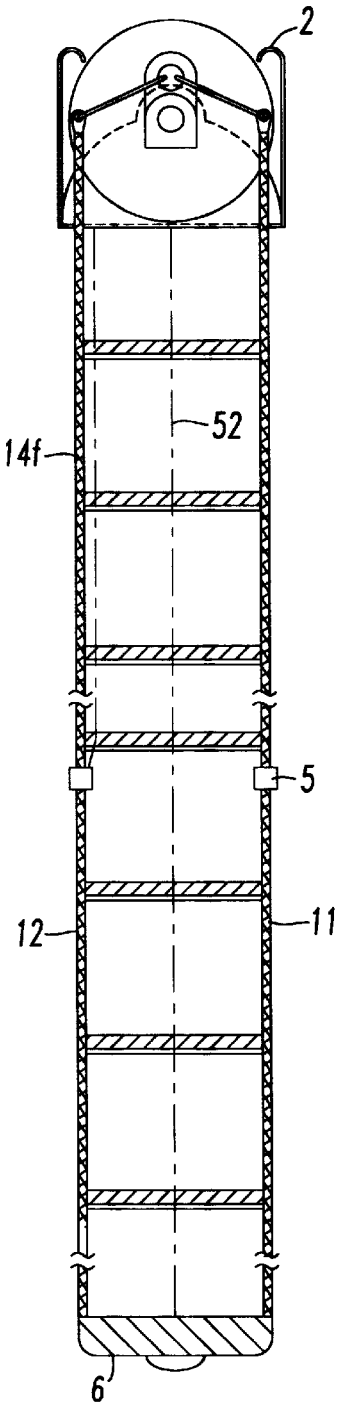
FIG. 17 is a sectional view similar to FIG. 11 of a third embodiment of my blind which utilizes center holes for the tilt cords.
Figure 18:
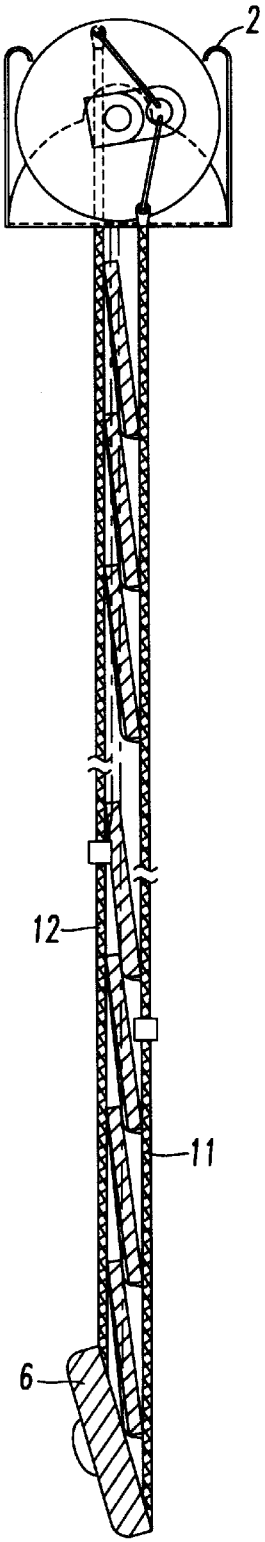
FIG. 18 is a sectional view similar to FIG. 17 showing the blind in a closed, tilted position.
Figure 19:
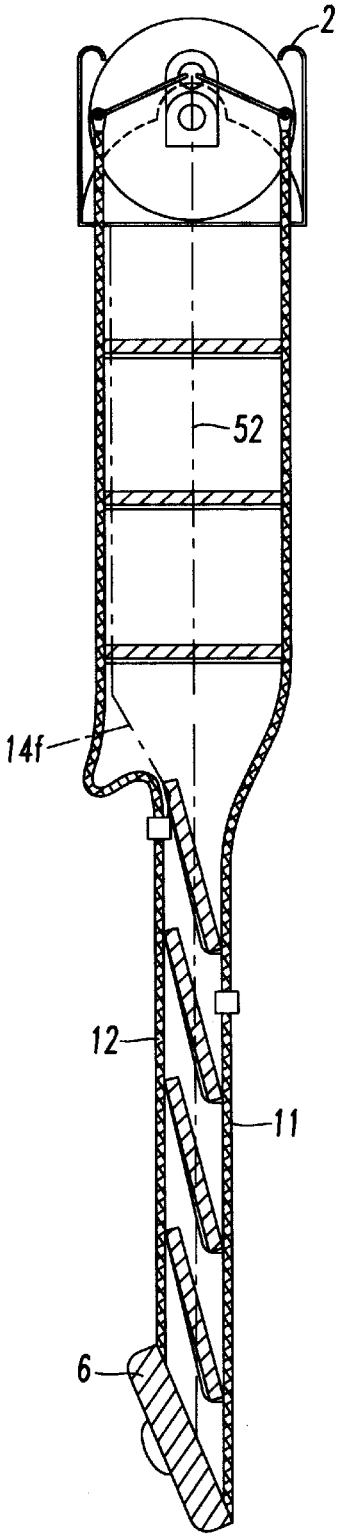
FIG. 19 is a sectional view similar to FIG. 17 showing the upper slats in an open, horizontal position and the lower slats in a closed, tilted position.

I provide at least one set of tilt cords 14 to lift the rear rails of the lower ladders thereby causing the lower slats to tilt to a closed position. As shown in FIGS. 11, 12 and 13, a tilt cord 14 runs from the headrail along the rear rail 12 of at least two upper ladders 4 and is attached to the coupler 5 which connects the upper ladder to the lower ladder 10.

The number of lift cords used will vary according to the size of the blind and cording arrangement. For instance, an edge lift system may be used to control the bottomrail, which would require at least one cord on the front and one on the back side of the bottomrail, and preferably two pairs of cords. This would allow for the use of slats with notches or grooves along which the lift cords and ends of ladder rungs pass.

As can be seen in FIG. 1, there is one disk for each pair of lift cords 21, 22, 23, 24. The disks 40 are mounted on a tilt rod 46 so that rotation of the tilt rod will turn the disks in unison. The tilt rod is suspended above the base of the headrail by cradles 50. A right angle drive or worm gear drive is provided at one end of tilt rod 46. The drive extends through the headrail 2 to provide a handle which is turned to open and close the blind. FIGS. 11 and 12, show the blind tilted opened and closed respectively. Rotation of the disks 40 in either direction lifts one lift cord 21 over the other 22 and pulls the cords closer together. The cord ladders 10 tilt as do the lift cords, with one rail 11 being raised while the other 12 is lowered. The tilt cords rotate along with the disks. The disks can be rotated 180 degrees. The blind slats 3, 9 will be in a nearly closed position after the disks 40 have been rotated through approximately 90 degrees. As the disks 40 are rotated the lift cords 21–24 and the rails 11 and 12 of the ladders are constantly in tension. This prevents lateral movement of the slats. By using this mechanism to tilt the lift cords 21–24, the weight of the blind is shifted along the center of gravity. The weight of the blind is not lifted or transferred, and as a result the blind stays in place parallel to the window.

As can be seen in FIG. 6, at least two front slots 16 are provided on the front edge of each slat 9. Corresponding rear slots 18 have been cut into the back edge of slat 9 opposite slots 16. The slots 16, 18 can be directly opposite one another as shown, or slots could be offset one to the left or right of the other. The slots are sized so that the lift cords 21, 22, 23, 24, which control the bottomrail and ends of rungs 13, can loosely fit therein. Cord ladders 10 are positioned evenly along the blind as necessary to support the slats, and near the ends of the blind. At least one set of the rails 11 and 12 are adjacent the lift cords. Slots 16,18 preferably have a depth so that only the lift cords 21–24 and ends of rungs 13, can completely fit therein. Thus the ladder rails 11,12 are ideally never fully within the slots.

Figure 8:
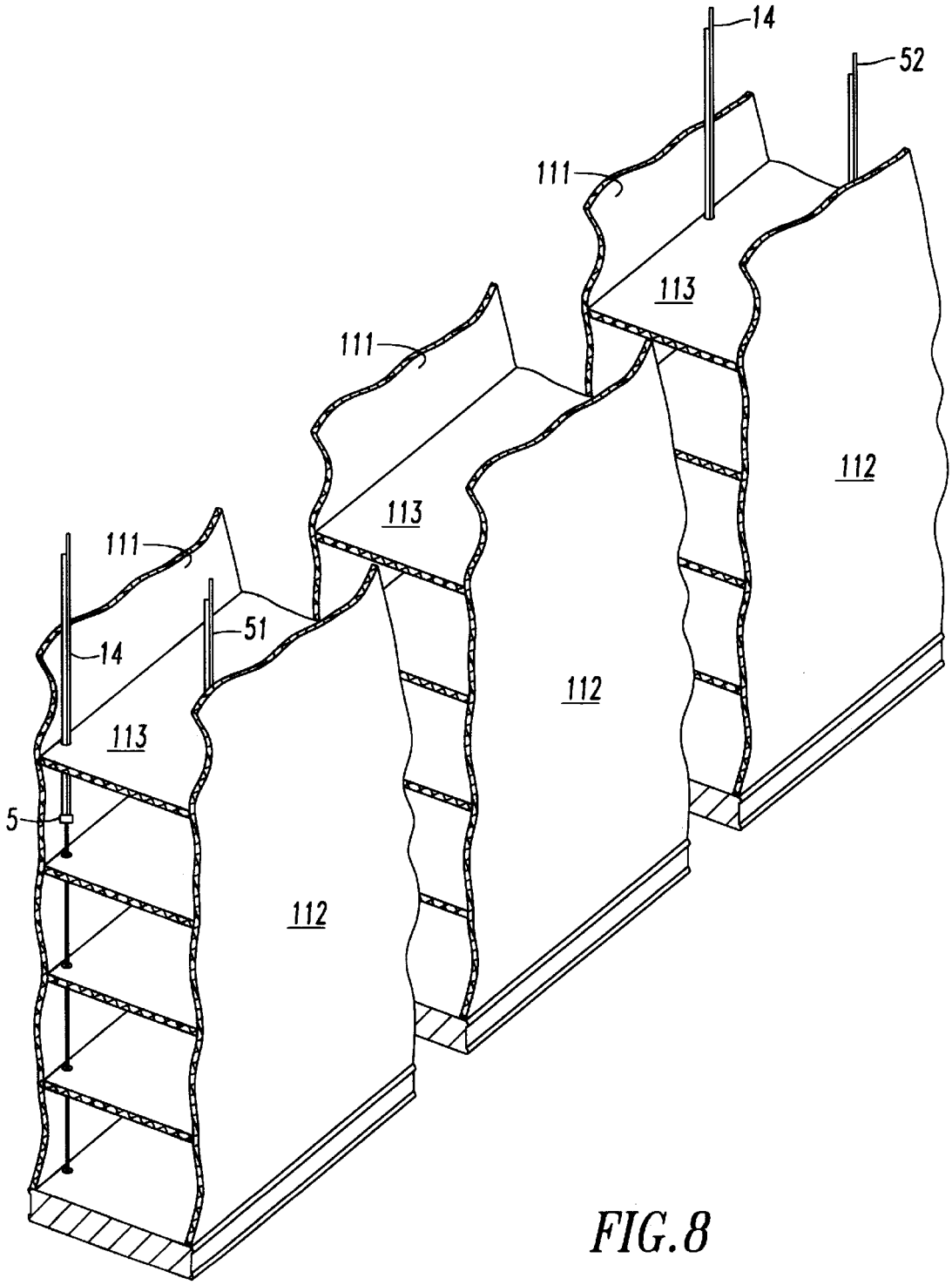
FIG. 8 is a perspective view similar to FIGS. 6 and 7 showing an alternative embodiment wherein the ladders are formed by sheets of material.
Figure 9:
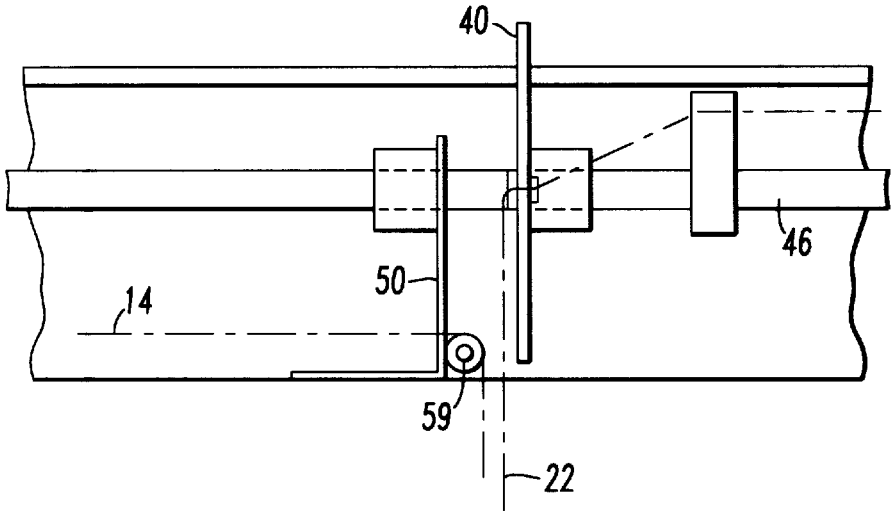
FIG. 9 is a front view of a portion of the headrail with the front panel removed to show cording arrangements and the tilt mechanism.
Figure 10:
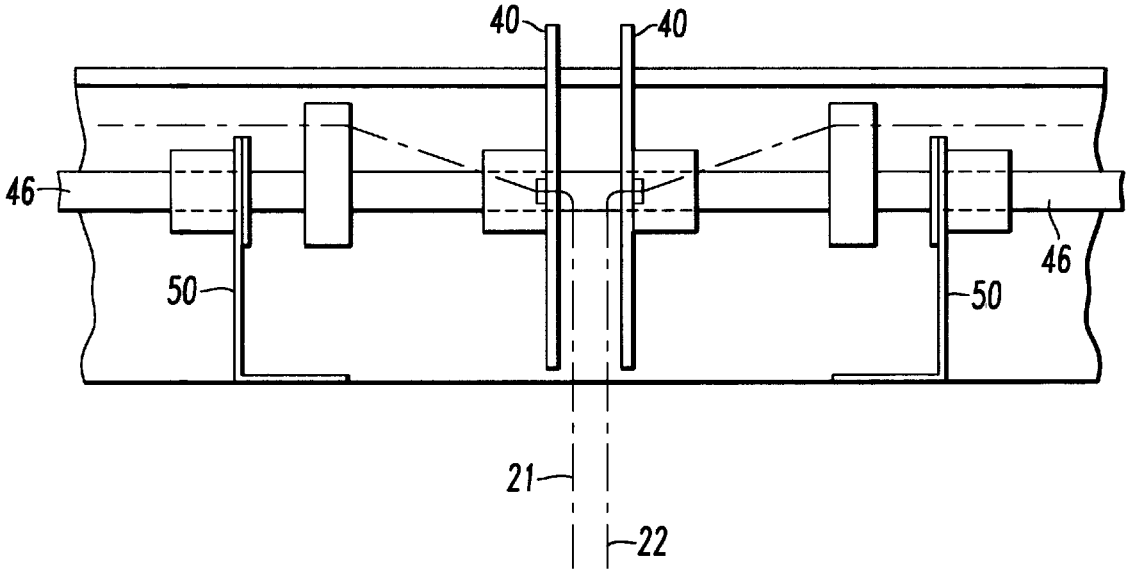
FIG. 10 is a front view of a portion of the headrail with the front panel removed to show alternate cording arrangements and the tilt mechanism.

Although most embodiments of my blind use cord type ladders, this is not required. As shown in FIG. 8 the ladders could be formed by two parallel sheets of light transmissive fabric 111 and 112 connected by fabric strips 113. These strips 113 may serve as rungs and support slats (not shown) or could be made of opaque material and function as both the rungs and the slats. In this case, movingrails are usually required. Movingrails are placed at the junction of the upper and lower ladders and are required whenever the space between tilt cords is greater than the slats can support themselves. The slats are lifted by the tilt cords and would sag between the points of support if the span is too great. Since the fabric sheet type blinds commonly use soft fabric slats, movingrails would be needed no matter what the size of the blind.

Figure 20:
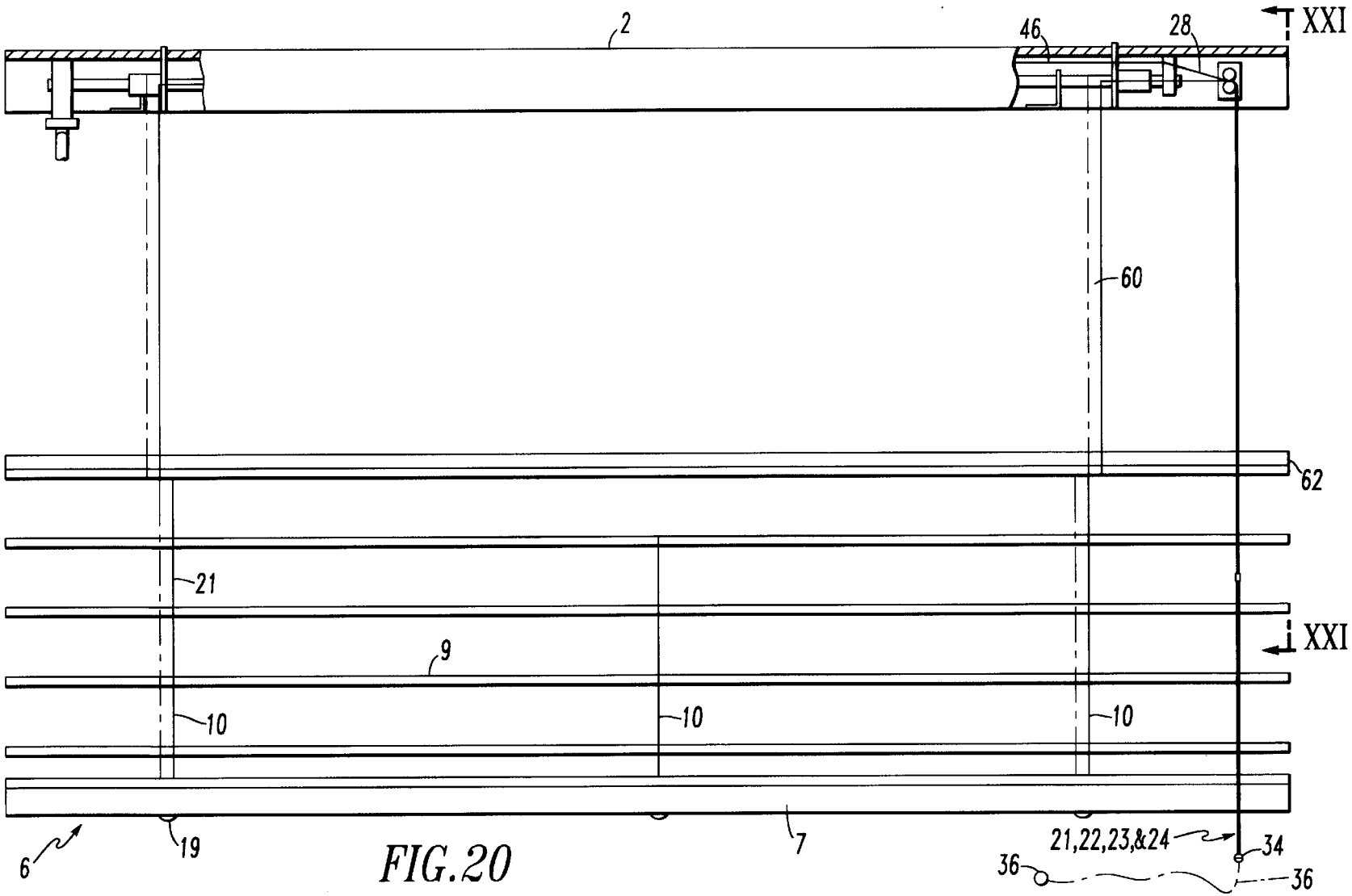
FIG. 20 is a front view similar to FIG. 1 of a fourth embodiment of my blind which has no upper slats.
Figure 21:
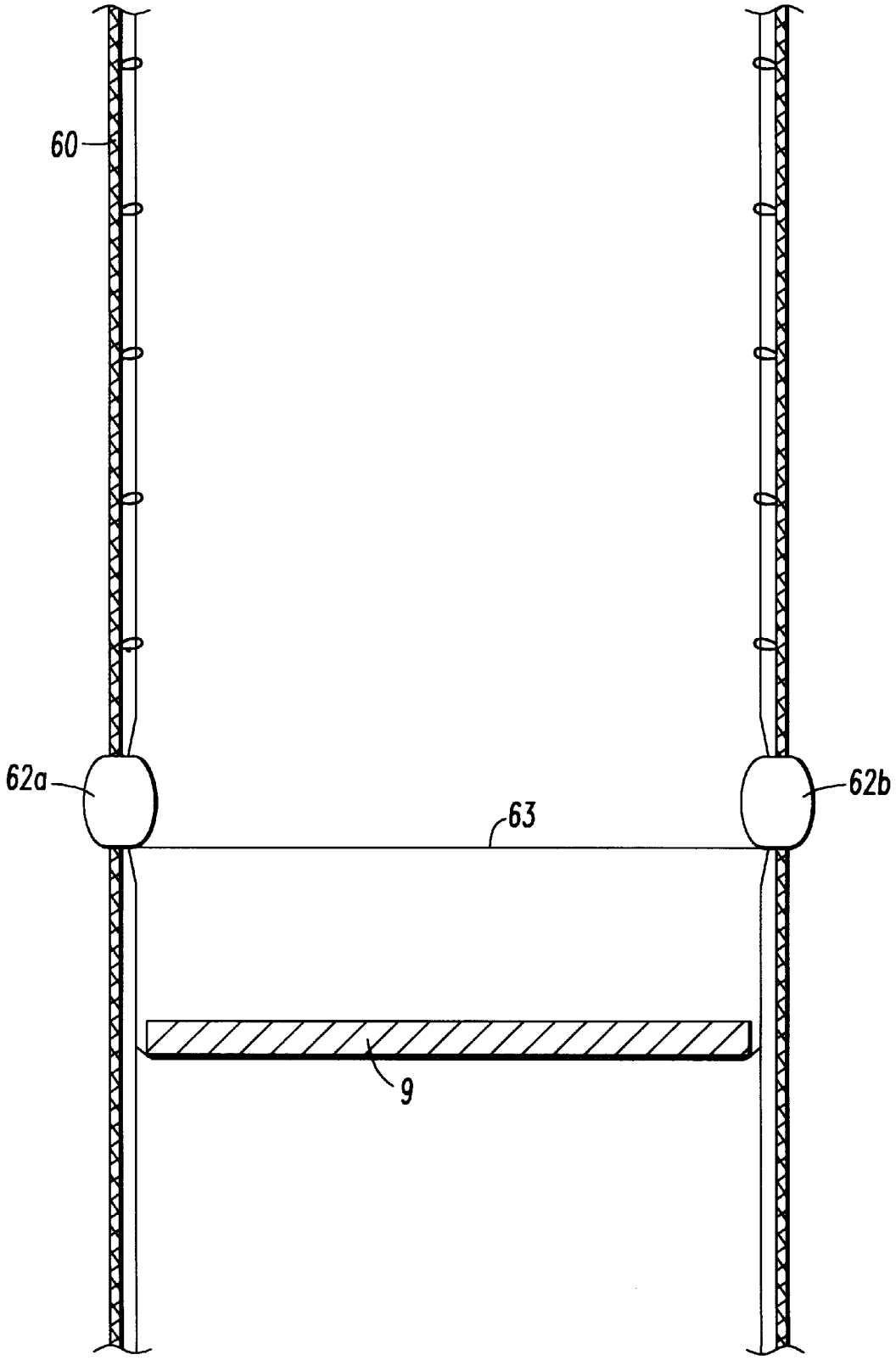
FIG. 21 is a side view of the fourth embodiment taken along the line XXI—XXI in FIG. 20.

The movingrails are very important in the fourth embodiment shown in FIGS. 20 and 21 where the upper ladders have no slats because the purpose of this embodiment is to be completely open on the top. It is undesirable to have ladders and lift cords in the space above the lower slats. It is preferred to have ladder rails and lift cords toward the outside edges where they are more likely to be hidden from view by the casing or mullions surrounding the glass. Descending ladders and lift cords may also be matched to the spacing of the mullions of the window. Since mullions are generally spaced farther apart than the span the slats can go unsupported, the movingrail bars make it possible to have more ladders on the lower section than in the upper section. It is also desirable to make the upper ladders of a different color and construction than the lower ladders. Since the upper ladders do not carry slats in this embodiment, the rungs may be replaced by cords 60 with loops 20 that guide the lift cords when either edge lift cording system are used. The ladders may also be black so that the light does not reflect off of them and makes them less noticeable and more "see-thru". The lift cords passing through the loops fold the ladders when the blind is lifted to a top stack. Since the lift cords are tilted in the same path as the ladders by the disks they always stay together.

The movingrail 62 is preferably made of two separate bars 62*a* and 62*b* that have a minimal thickness that are bound together with a very flexible member 63 that prevents them from splaying out when the blind is lifted. Alternately, the bottomrail lift cords 21, 22, 23, 24 can pass through the bars and thereby prevent them from splaying out since the weight of the blind is keeping the lift cords in tension.

Narrow blinds can use couplers similar to couplers 5 in the first embodiment instead of movingrails to join the upper ladders 60 to the lower ladders 4 since the span is narrow.

Very little specialized hardware is needed, because the disk hardware ordinarily tilts the lift cords in tandem with the ladders. The tilt cords are also tilted in tandem by using the same hardware. The manufacturer can use a few pre-existing pieces of hardware to create a headrail which can then be used for any type of blind: bottom and top stacking, traditional top stacking, centerline lifting, or edge (off-set holes or slots) lifting, or any combination of these.

Although I have shown and described certain present preferred embodiments of my venetian blind it should be distinctly understood that the invention is not limited thereto but may be variously embodied within the scope of the following claims.

I claim:

1. A venetian type blind comprising:

a bottomrail;

a headrail positioned above the bottomrail;

a plurality of upper ladders extending from the headrail toward the bottomrail, each upper ladder having a front rail and a rear rail, each front rail and rear rail having a lower terminal end;

a tilt mechanism attached to the headrail and to which the upper ladders are connected;

a plurality of lower ladders extending from the bottomrail toward the headrail, each lower ladder having a front rail and a rear rail and being connected to an upper ladder, each front rail and rear rail having an upper terminal end;

at least one connection device positioned between the headrail and the bottomrail which is adapted to connect tilt cords to the lower ladders;

a plurality of upper slats carried on the upper ladders;

a plurality of lower slats carried on the lower ladders;

at least two bottomrail lift cords attached to the bottomrail, running past the lower slats and the upper slats and passing through the headrail; and at least two tilt cords, each tilt cord running through the headrail, passing adjacent to a rail of an upper ladder, and connected to a lower ladder.

2. The venetian type blind of claim 1 wherein each slat has an inside edge, an outside edge, at least two slots on the outside edge and one slot on the inside edge each slot being adjacent to a ladder, one lift cord running through one of the slots so that there is a lift cord running through each slot.

3. The venetian type blind of claim 2 wherein the slots have a depth substantially equal to a diameter of the lift cords.

4. The venetian type blind of claim 1 wherein the tilt mechanism is comprised of:

a first disk to which one pair of ladder rails are attached;

a second disk to which a second pair of ladder rails are attached;

an axle attached between the first disk and the second disk; and means for rotating the axle and attached disks.

5. The venetian type blind of claim 4 wherein at least one of the lift cords passes through at least one of the first disk and the second disk.

6. The venetian type blind of claim 4 wherein the means for rotating the axle and attached disks is one of a right angle drive and a worm drive.

7. The venetian type blind of claim 1 wherein the slats are one of wood, aluminum and plastic.

8. The venetian type blind of claim 1 also comprising a cord lock through which the lift cords pass, wherein the cord lock is always engaged unless the lift cords are being operated and wherein the cord lock is not engaged when the ladders are fully extended.

9. The venetian type blind of claim 1 wherein the at least one connection device is a plurality of couplers such that there is one coupler for each rail of the upper ladders and each coupler connects a rail of an upper ladder to a rail of a lower ladder.

10. The venetian type blind of claim 1 wherein the at least two lift cords are adjacent front rails of the ladder also comprising at least two rear tilt cords, each rear tilt cord running through the headrail, passing adjacent to the rear rail of an upper ladder, and connected to the rear rail of a lower ladder.

11. The venetian type blind of claim 1 wherein the rungs of the upper ladders and the lower ladders are comprised of a plurality of strands and at least one of the upper slats and the lower slats is threaded through the plurality of stands.

12. The venetian type blind of claim 1 wherein the bottomrail is comprised of two spaced apart parallel bottom rail portions.

13. The venetian type blind of claim 1 wherein each bottomrail lift cord passes through a hole in each slat.

14. The venetian type blind of claim 1 also comprising a cord lock attached to the headrail and through which the tilt cords pass.

15. The venetian type blind of claim 1 also comprising loops attached to at least some of the rails of the upper ladders.

16. A venetian type blind comprising:

a bottomrail;

a headrail positioned above the bottomrail;

a plurality of upper ladders extending from the headrail toward the bottomrail, each upper ladder having a front rail and a rear rail, each front rail and rear rail having a lower terminal end;

a tilt mechanism attached to the headrail and to which the upper ladders are connected;

a plurality of lower ladders extending from the bottomrail toward the headrail, each lower ladder having a front rail and a rear rail and being connected to an upper ladder, each front rail and rear rail having an upper terminal end;

at least one connection device positioned between the headrail and the bottomrail which is adapted to connect tilt cords to the lower ladders;

a plurality of lower slats carried on the lower ladders;

at least two bottomrail lift cords attached to the bottomrail, running past the lower slats and passing through the headrail; and at least two tilt cords, each tilt cord running through the headrail, passing adjacent to a rail of an upper ladder, and connected to a lower ladder.

17. The venetian type blind of claim 16 wherein each slat has an inside edge, an outside edge, at least two slots on the outside edge and one slot on the inside edge each slot being adjacent to a ladder, one lift cord running through one of the slots so that there is a lift cord running through each slot.

18. The venetian type blind of claim 17 wherein the slots have a depth substantially equal to a diameter of the lift cords.

19. The venetian type blind of claim 17 wherein the tilt mechanism is comprised of:

a first disk to which one pair of ladder rails are attached;

a second disk to which a second pair of ladder rails are attached;

an axle attached between the first disk and the second disk; and means for rotating the axle and attached disks.

20. The venetian type blind of claim 19 wherein at least one of the lift cords passes through at least one of the first disk and the second disk.

21. The venetian type blind of claim 19 wherein the means for rotating the axle and attached disks is one of a right angle drive and a worm drive.

22. The venetian type blind of claim 16 wherein the slats are one of wood, aluminum and plastic.

23. The venetian type blind of claim 16 also comprising a cord lock through which the lift cords pass, wherein the cord lock is always engaged unless the lift cords are being operated and wherein the cord lock is not engaged when the ladders are fully extended.

24. The venetian type blind of claim 16 wherein the at least one connection device is a bar.

25. The venetian type blind of claim 16 wherein the at least one connection device is a pair of bars.

26. The venetian type blind of claim 16 wherein the at least one connection device is a plurality of couplers such that there is one coupler for each rail of the upper ladders and each coupler connects a rail of an upper ladder to a rail of a lower ladder.

27. The venetian type blind of claim 16 wherein the at least two lift cords are adjacent front rails of the upper and lower, ladder, said at least two tilt cords also comprising at least two rear tilt cords, each rear tilt cord running through the headrail, passing adjacent to the rear rail of an upper ladder, and connected to the rear rail of a lower ladder.

28. The venetian type blind of claim 16 wherein the rungs of the upper ladders and lower ladders are comprised of a plurality of strands and the lower slats are threaded through the plurality of stands.

29. The venetian type blind of claim 16 wherein the bottomrail is comprised of two spaced apart parallel bottom rail portions.

30. The venetian type blind of claim 16 wherein the at least one connector is a movingrail and also comprising at least two movingrail lift cords attached to the movingrail and passing through the headrail.

31. The venetian type blind of claim 16 wherein each bottomrail lift cord passes through a hole in each slat.

32. The venetian type blind of claim 16 wherein the opposite rails of the at least one of the upper ladders and the lower ladders are formed by a first sheet of fabric adjacent an inside edge of the slats and a second sheet of fabric adjacent an outside edge of the slats.

33. The venetian type blind of claim 16 also comprising a cord lock attached to the headrail and through which the tilt cords pass.

34. The venetian type blind of claim 16 also comprising loops attached to at least some of the rails of the upper ladders.

* * * * *

UNITED STATES PATENT AND TRADEMARK OFFICE

CERTIFICATE OF CORRECTION

PATENT NO. : 6,105,652

DATED : August 22, 2000

INVENTOR(S) : REN JUDKINS

It is certified that error appears in the above-indentified patent and that said Letters Patent is hereby corrected as shown below:

Column 9, line 33, claim 11, change "stands" to --strands--.

Column 10, line 41, claim 27, after "lower", delete ",".

Column 10, line 48, claim 28, change "stands" to --strands--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*